US010957236B2

(12) United States Patent
Liao et al.

(10) Patent No.: US 10,957,236 B2
(45) Date of Patent: Mar. 23, 2021

(54) DRIVING METHOD FOR SOURCE DRIVER AND RELATED DISPLAY SYSTEM

(71) Applicant: NOVATEK Microelectronics Corp., Hsin-Chu (TW)

(72) Inventors: Yen-Tao Liao, Hsinchu (TW); Hung-Hsiang Chen, Hsinchu (TW); Jen-Ta Yang, Hsinchu County (TW); Yi-Wei Lin, Tainan (TW); Huang-Chin Tang, Hsinchu County (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 16/395,247

(22) Filed: Apr. 26, 2019

(65) Prior Publication Data

US 2020/0342801 A1 Oct. 29, 2020

(51) Int. Cl.
*G09G 3/20* (2006.01)

(52) U.S. Cl.
CPC ... *G09G 3/2003* (2013.01); *G09G 2300/0452* (2013.01); *G09G 2310/027* (2013.01); *G09G 2310/08* (2013.01); *G09G 2320/0666* (2013.01); *G09G 2330/028* (2013.01)

(58) Field of Classification Search
CPC ..... G09G 3/2003; G09G 2300/0452; G09G 2310/027; G09G 2310/08; G09G 2320/0666; G09G 2330/028
See application file for complete search history.

(56) References Cited

U.S. PATENT DOCUMENTS

| | | | | |
|---|---|---|---|---|
| 8,284,143 | B2 | 10/2012 | Park | |
| 9,837,031 | B2 * | 12/2017 | You | G09G 3/3648 |
| 2007/0146273 | A1 * | 6/2007 | You | G09G 3/3648 345/89 |
| 2009/0009493 | A1 * | 1/2009 | Hong | G09G 3/3648 345/204 |
| 2009/0289961 | A1 * | 11/2009 | Kim | G09G 3/3406 345/690 |
| 2012/0056915 | A1 * | 3/2012 | Shibazaki | G02F 1/133371 345/690 |
| 2014/0160178 | A1 * | 6/2014 | Hong | G09G 3/2007 345/690 |

(Continued)

FOREIGN PATENT DOCUMENTS

| | | |
|---|---|---|
| TW | I413976 | 11/2013 |
| TW | I511523 B | 12/2015 |
| TW | I627473 B | 6/2018 |

*Primary Examiner* — Michael Pervan
(74) *Attorney, Agent, or Firm* — Winston Hsu

(57) ABSTRACT

The present invention discloses a driving method for a source driver, for driving a source line of a display panel. The driving method includes the steps of: driving the source line with a first voltage or a second voltage smaller than the first voltage in a first driving cycle; driving the source line with the first voltage in a second driving cycle next to the first driving cycle when the source line is driven with the first voltage in the first driving cycle; and driving the source line with an overdrive voltage in the second driving cycle when the source line is driven with the second voltage in the first driving cycle. The first voltage is a normal high voltage of the display panel, and the overdrive voltage is greater than the normal high voltage.

10 Claims, 9 Drawing Sheets

General gamma voltage generator

Gamma voltage generator 104

(56) References Cited

U.S. PATENT DOCUMENTS

2015/0364077 A1* 12/2015 Liu ..... G09G 3/3696
345/691
2019/0371258 A1* 12/2019 Morein ..... G09G 3/3677

* cited by examiner

DRIVING METHOD FOR SOURCE DRIVER AND RELATED DISPLAY SYSTEM

BACKGROUND OF THE INVENTION

1. Field of the Invention

The present invention relates to a driving method for a source driver and a related display system, and more particularly, to a method of overdriving source lines for a source driver and a related display system.

2. Description of the Prior Art

In liquid crystal display (LCD) panels, insufficient charging is a prevalent problem widely discussed and considered. Since amorphous silicon thin-film transistor (TFT) LCD panels have become the mainstream of LCD panels, the insufficient charging problem becomes more serious due to the lower mobility of amorphous silicon. Also, with the evolvement of touch sensing technology, the in-cell touch scheme is widely used in the panel of mobile phones. The in-cell touch requires time division such that parts of the original display time are allocated to touch sensing operations. Further, with the higher resolution and higher screen-to-body ratio in modern mobile phone trends, a fixed display and touch period length needs to support more horizontal lines; that is, each horizontal line is able to utilize much shorter charging time compared to old LCD panels.

Overdrive is a driving technology commonly used to solve the insufficient charging problem. In the conventional overdrive methods, the gray level code is modified (or compensated) to a value further from the previous gray level code, allowing the source line to be driven to an over-high voltage level. However, the overdrive performance may not be satisfactory if the original gray level code approximates its maximum value while the overdrive operation requires a much higher value. This much higher value may not be reached due to the limitation of maximum gray level data. For example, if the gray level code changes from the minimum code L0 to the maximum code L255, the overdrive operation requires a higher code but the overdrive processing device can only output the code L255 in maximum; hence, the overdrive compensation for high gray level codes may not be effective, and the variation in high brightness cannot be well identified by users, resulting in reduced image quality in higher brightness.

Thus, there is a need to provide an effective overdrive method to provide satisfactory performance of overdrive compensation for high brightness and also solve the insufficient charging problem.

SUMMARY OF THE INVENTION

It is therefore an objective of the present invention to provide a novel overdrive method to drive the source line of the panel.

An embodiment of the present invention discloses a driving method for a source driver, for driving a source line of a display panel. The driving method comprises the steps of: driving the source line with a first voltage or a second voltage smaller than the first voltage in a first driving cycle; driving the source line with the first voltage in a second driving cycle next to the first driving cycle when the source line is driven with the first voltage in the first driving cycle; and driving the source line with an overdrive voltage in the second driving cycle when the source line is driven with the second voltage in the first driving cycle. The first voltage is a normal high voltage of the display panel, and the overdrive voltage is greater than the normal high voltage.

Another embodiment of the present invention discloses a display system, which comprises a display panel, a timing controller, a gamma voltage generator and a source driver. The display panel comprises a plurality of source lines. The timing controller is configured to output a first gamma data, a second gamma data and an overdrive gamma data according to a first gray level data and a second gray level data. The gamma voltage generator, coupled to the timing controller, is configured to output a first voltage corresponding to the first gamma data, a second voltage corresponding to the second gamma data, and an overdrive voltage corresponding to the overdrive gamma data. The source driver, coupled to the display panel and the gamma voltage generator, is configured to perform the following steps: driving a source line among the plurality of source lines with the first voltage or the second voltage smaller than the first voltage in a first driving cycle; driving the source line with the first voltage in a second driving cycle next to the first driving cycle when the source line is driven with the first voltage in the first driving cycle; and driving the source line with the overdrive voltage in the second driving cycle when the source line is driven with the second voltage in the first driving cycle. The first voltage is a normal high voltage of the display panel, and the overdrive voltage is greater than the normal high voltage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
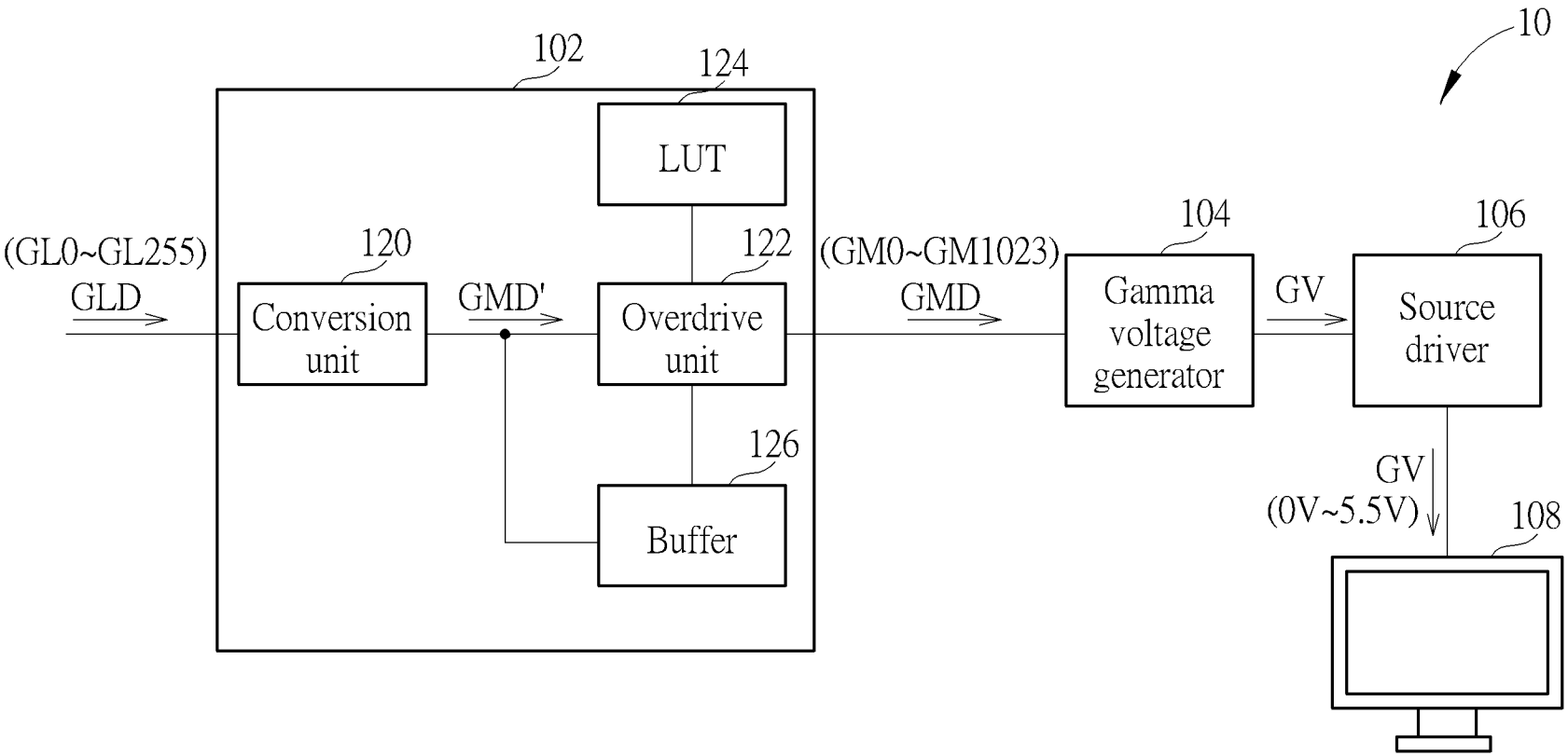
FIG. 1 is a schematic diagram of a display system according to an embodiment of the present invention.

Please refer to FIG. 1, which is a schematic diagram of a display system 10 according to an embodiment of the present invention. As shown in FIG. 1, the display system 10 includes a timing controller 102, a gamma voltage generator 104, a source driver 106, and a display panel 108. The display panel 108 includes a plurality of subpixels arranged as an array, and each column of subpixels are connected to a source line and receive driving voltages from the source driver 106 through the source line. The display panel 108 may be any type of panel capable of display functions, such as a liquid crystal display (LCD) panel, organic light-emitting diode (OLED) panel, and the like. The timing controller 102, the gamma voltage generator 104 and the source driver 106 may be implemented as respective integrated circuit (IC), or integrated in a single IC as an all-in-one system. The timing controller 102 is configured to receive gray level data GLD from a host or a processor (not illustrated), and convert the gray level data GLD into gamma data GMD. The gamma voltage generator 104 is configured to receive the gamma data GMD and output gamma voltage GV corresponding to the gamma data GMD. The gamma voltage generator 104 may include a resister ladder which is capable of generating multiple voltages within a predefined range conforming to designs of the display panel 108. The source driver 106, coupled between the gamma voltage generator 104 and the display panel 108, is configured to drive one of the source lines in the display panel 108 with the gamma voltage GV received from the gamma voltage generator 104, allowing a specific subpixel connected to the source line to show desired brightness. More specifically, the source driver 106 may include an operational amplifier for outputting the gamma voltage GV to the source line, allowing the liquid crystal capacitor in the specific subpixel connected to the source line to receive a target voltage that is capable of showing the desired brightness.

Figure 2:
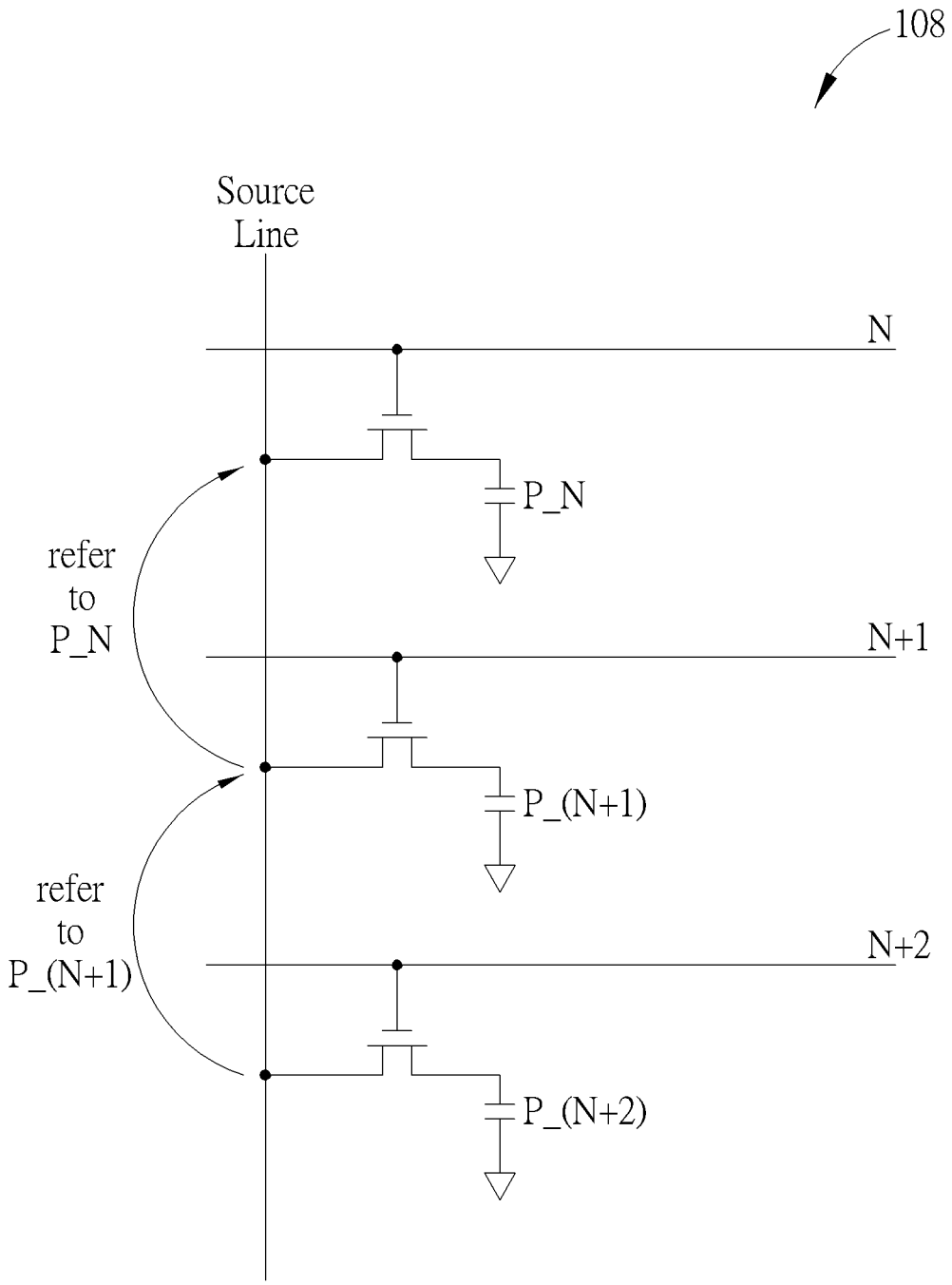
FIG. 2 illustrates an exemplary structure of the display panel shown in FIG. 1.

FIG. 2 illustrates an exemplary structure of the display panel 108. As shown in FIG. 2, the display panel 108 includes three adjacent subpixels P_N, P_(N+1) and P_(N+2) in rows N, (N+1) and (N+2), respectively, and the subpixels P_N, P_(N+1) and P_(N+2) are connected to the same source line. The source lines of the display panel 108 receive pixel data (i.e., gamma voltages) in a top-down order. Due to the RC loading on the display panel 108, the subpixel may not be charged to its target voltage level if the charging time is not enough. Thus, the source driver 106 may output an over-high voltage to overdrive the source line, allowing the subpixel to reach its target voltage level within the limited charging time. The overdrive degree is predicted based on the voltage to be transmitted to the source line and the voltage currently existing on the source line. For example, the voltage for the subpixel P_(N+1) is determined by referring to the voltage for the subpixel P_N, and the voltage for the subpixel P_(N+2) is determined by referring to the voltage for the subpixel P_(N+1). With a larger difference between the voltage to be transmitted to the source line and the voltage currently existing on the source line, the overdrive should provide more compensation on the follow-up voltage to be transmitted to the source line.

In order to realize the overdrive operation, the timing controller 102 may include a conversion unit 120, an overdrive unit 122, a lookup table (LUT) 124 and a buffer 126. The conversion unit 120 is configured to convert the received gray level data GLD into original gamma data GMD' with one-to-one mapping. The conversion from gray level data to gamma data may follow any available gamma voltage standard such as Gamma 2.0, Gamma 2.2 or Gamma 2.4, and/or may be performed based on the image characteristics of the display panel 108 and/or based on the color corresponding to the gray level data GLD. The overdrive unit 122 then performs overdrive to generate the gamma data GMD according to the original gamma data GMD' and the previous gamma data obtained from the buffer 126 by referring to the LUT 124. In an embodiment, the gray level data GLD ranges from gray level codes GL0 to GL255 (as an 8-bit data), and the gamma data GMD ranges from gamma codes GM0 to GM1023 (as a 10-bit data). In general, the gamma data may have a finer resolution to achieve higher precision of displayed color.

Different from the conventional overdrive method performed in the gray level domain, the overdrive method of the present invention is performed in the gamma voltage domain. In other words, in the embodiments of the present invention, the overdrive operation is performed on the original gamma data GMD' after it is converted from the gray code. The original gamma data GMD' is then converted into the gamma data GMD through the overdrive operation of the overdrive unit 122, and each gamma data GMD may be converted into a gamma voltage GV with one-to-one mapping.

Since the proposed overdrive operation is performed on the gamma data, the problem that the overdrive is not effective for high gray level data may be solved. In an embodiment where the gray level data GLD ranges from the gray level codes GL0 to GL255 and the gamma data GMD ranges from the gamma codes GM0 to GM1023, the gray level data GLD may be mapped to the original gamma data GMD' with gamma codes from GM0 to a predefined gamma code, e.g., GM900. The original gamma data GMD' are further mapped to normal gamma voltages outputted to the display panel 108 from the source driver 106. The overdrive operation allows the gamma voltage generator 104 to provide an overdrive gamma voltage higher than the normal gamma voltages. If the normal gamma voltage to be transmitted to the display panel 108 is the normal high voltage 5V (corresponding to the gamma code GM900), the overdrive voltage may be up to 5.5V (corresponding to gamma code GM1023). In such a situation, the gamma voltage generator 104 has headroom allowing the source line to be driven by an overdrive voltage higher than its normal high voltage. In this embodiment, the normal high voltage corresponds to the maximum brightness of each of the red, green and blue colors shown on the display panel 108. More specifically, the normal high voltage may entirely turn on the liquid crystal molecules to achieve the maximum brightness.

Figure 3:
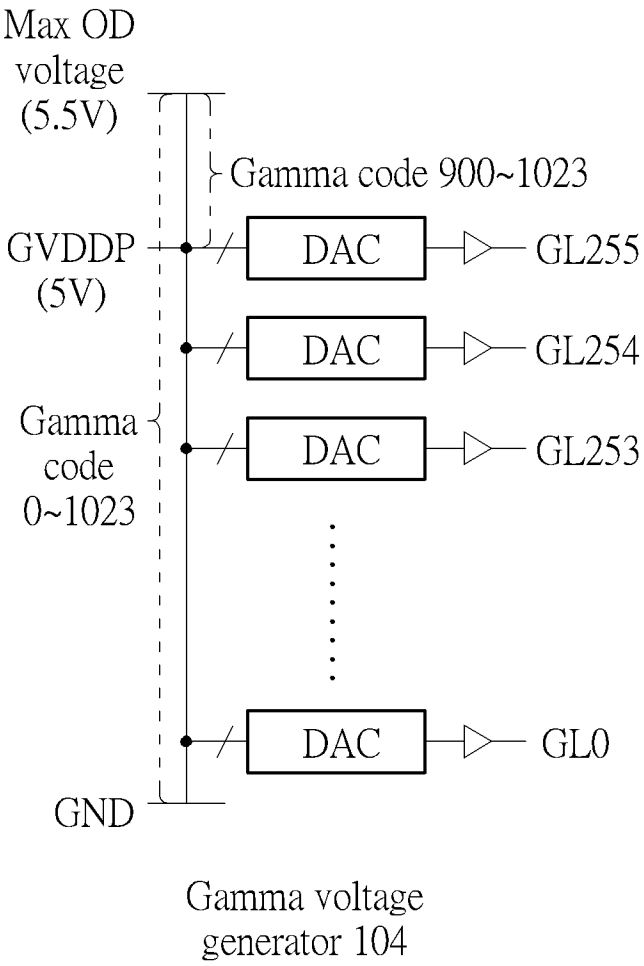
FIG. 3 is a schematic diagram of an exemplary structure of the gamma voltage generator of the present invention in comparison with a general gamma voltage generator structure.
Figure 3:
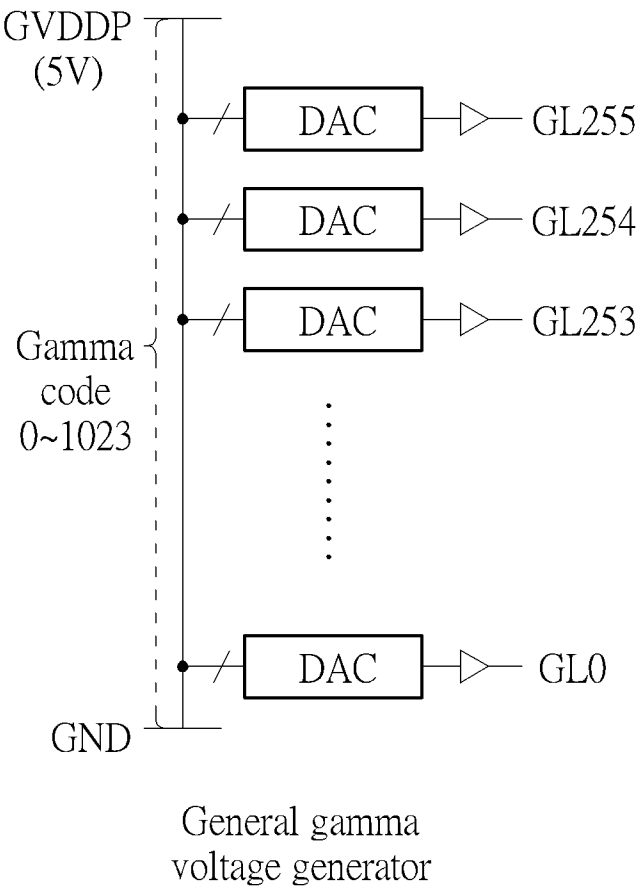

For example, please refer to FIG. 3, which is a schematic diagram of an exemplary structure of the gamma voltage generator 104 of the present invention in comparison with a general gamma voltage generator structure. In the general gamma voltage generator, various gray levels are converted into gamma voltages spread between the normal low voltage GND and the normal high voltage GVDDP, where the normal high voltage GVDDP may be 5V and corresponding to the maximum gamma code GM1023. In comparison, in the gamma voltage generator 104, various gray levels are converted into gamma voltages spread between the normal low voltage GND and the normal high voltage GVDDP, where the normal high voltage GVDDP may be 5V and corresponding to the gamma code GM900. The gamma voltage generator 104 further supports an overdrive voltage higher than the normal high voltage 5V. For example, the maximum overdrive voltage corresponding to the maximum gamma code GM1023 may be up to 5.5V.

As mentioned above, in the conventional overdrive scheme, overdrive is performed in the gray level domain, and thus the maximum allowable overdrive output is limited to the maximum gray level data such as the gray level code GL255, which results in that the voltage outputted to the source line is limited under the normal high voltage. In comparison, in the gamma voltage generator of the present invention, overdrive is performed in the gamma voltage domain. With the well-configured conversion between gray level data and gamma voltages while the overdrive operation is performed after the gray level data is converted into the gamma data, the maximum voltage outputted to the source line may exceed the normal high voltage that may be converted from the maximum gray level of a color such as red, green or blue. In such a situation, the overdrive voltage compensation may exceed the limitation of the maximum gray level data, leading to better overdrive effects for higher gray level data.

Figure 4:
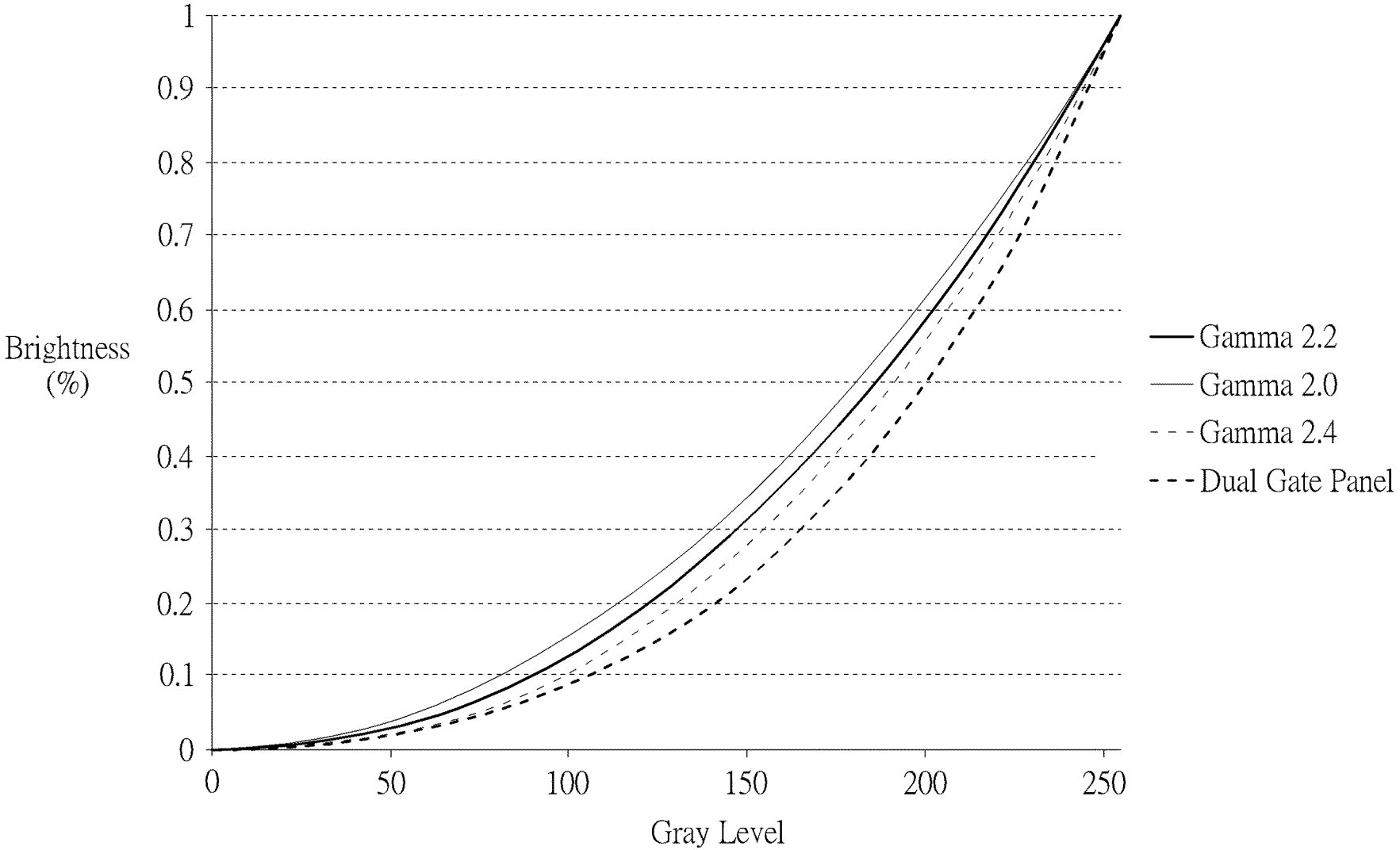
FIG. 4 is a schematic diagram of different gamma curves.

In addition, since the overdrive operation is performed based on the gamma voltage to be transmitted to the source line, the degree of overdrive may be effectively predicted according to the voltage difference between two consecutive voltages transmitted from the source driver 106 to the same source line. For example, larger voltage difference between two consecutive voltages may be compensated by higher overdrive degree; that is, the gamma data GMD is configured to have a larger difference compared with the original gamma data GMD'. The related information may be recorded in the LUT 124 and referred by the overdrive unit 122, as shown in FIG. 1. As mentioned above, the insufficient charging problem is generated due to insufficient charging time with the RC loading of the panel, where the variation of charging voltage is strongly influenced by the RC loading. Therefore, the overdrive operation based on the gamma voltage may achieve better preciseness of the overdrive degree. Note that the gray level data may generate different image brightness on different types of panels, and thus different gamma curves may be selected in order to achieve better image quality. As shown in FIG. 4, the gray level data may follow different gamma curves to be converted into gamma data and gamma voltages for different types of panels (such as the dual gate panel) or panels with different characteristics. Also, different colors (red or green or blue) may apply different gamma curves or require additional gamma corrections. The nonlinearity and variance of the gamma curves cause that the overdrive operations based on gray level data are difficult to be performed with higher preciseness.

In addition, since the conventional overdrive method is performed based on the difference of gray level data rather than the difference of gamma voltages, the compensation of overdrive may result in discontinuous in output voltages due to the nonlinear mapping of the gray level data and the gamma voltages. The discontinuity is easily observed by a user in an image having gradient color. In comparison, the overdrive method of the present invention is performed based on the difference of gamma voltages, where the problem of discontinuous output voltages after overdrive compensation may be prevented.

Please keep referring to FIGS. 1-3, where the overdrive operation may be performed based on the gamma voltages transmitted to subpixels in two adjacent rows. The subpixels P_N and P_(N+1) connected to the same source line are taken as an example. In a first case, two consecutive maximum gray level codes GL255 need to be displayed; hence, the subpixel P Nis configured to receive the normal high voltage 5V corresponding to the gray level code GL255 (and the gamma code GM900), and the source driver 108 drives the source line with the voltage 5V in the corresponding driving cycle. As for the subpixel P_(N+1), the overdrive unit 122 may determine that no overdrive is required; hence, the subpixel P_(N+1) is configured to receive the normal high voltage 5V, and the source driver 108 drives the source line with the voltage 5V in the corresponding driving cycle. In a second case, a minimum gray level code GL0 and a maximum gray level code GL255 need to be displayed in the subpixels P_N and P_(N+1); hence, the subpixel P_N is configured to receive the normal low voltage (e.g., 0.2V) corresponding to the gray level code GL0 (and the gamma code GM0), and the source driver 108 drives the source line with the voltage 0.2V in the corresponding driving cycle. As for the subpixel P_(N+1), the overdrive unit 122 may determine that overdrive is required. Since the subpixel P_(N+1) is configured to receive the normal high voltage 5V while the source line is 0.2V in the previous driving cycle, the source driver 108 drives the source line with the overdrive voltage 5.5V (corresponding to the gamma code GM1023) in this driving cycle. Note that the overdrive scheme is feasible if a gamma voltage follows a lower gamma voltage on the same source line with voltage difference greater than a threshold. For example, when the subpixel P_(N+1) is configured to receive the normal high voltage 5V, the source line may be overdriven with an overdrive voltage greater than 5V for the subpixel P_(N+1) if the voltage of the previous subpixel P_N is smaller than a threshold, e.g., 4V. The related information may be recorded in the LUT 124 and referred by the overdrive unit 122.

Figure 5:
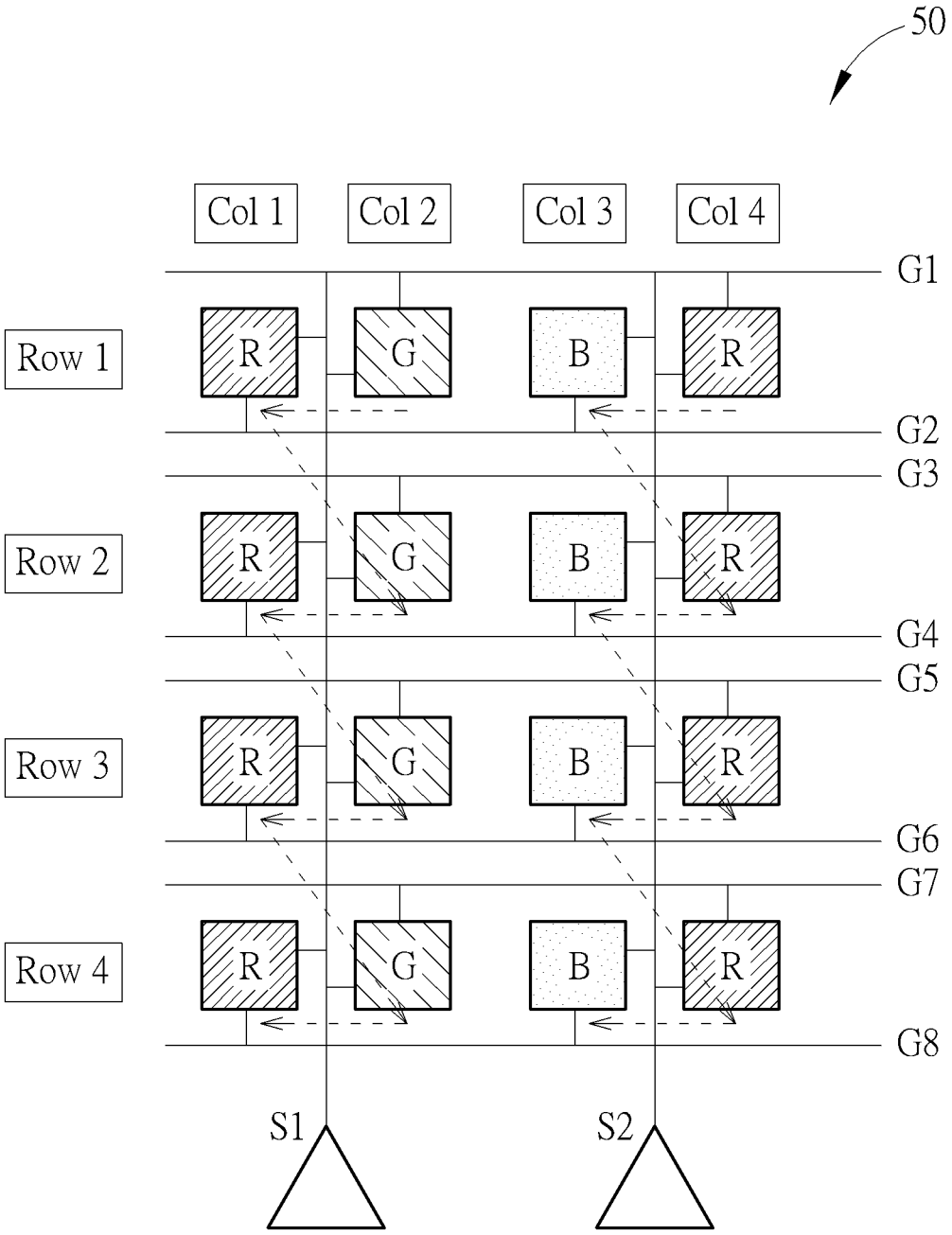
FIG. 5 is a schematic diagram of a display panel having the dual gate structure.

Please note that the insufficient charging problem may become more serious in a dual gate panel structure. Please refer to FIG. 5, which is a schematic diagram of a display panel 50 having the dual gate structure. In an embodiment, the display panel 50 with the dual gate structure may be implemented as the display panel 108 to be driven with the overdrive method of the present invention. In the dual gate structure, every two columns of subpixels share the same source line, so that the number of source lines may be reduced by half, which reduces the border length of the display panel. FIG. 5 illustrates 16 subpixels deployed in a 4×4 array, and those skilled in the art should understand that the display panel 50 may include hundreds or thousands of subpixels with similar structure. The four rows Row1-Row4 of subpixels are respectively controlled by eight gate lines G1-G8. The columns Col1-Col2 of subpixels share the same source line S1, and the columns Col3-Col4 of subpixels share the same source line S2. In this embodiment, the columns Col1, Col2, Col3 and Col4 of subpixels show the colors red (R), green (G), blue (B) and red (R), respectively. Since every two columns of subpixels share the driving time of a source line, the charging time for each subpixel is divided by two, which aggravates the insufficient charging problem.

FIG. 5 further shows an exemplary voltage reception order of the subpixels (as the dashed arrow). In this implementation, the green subpixels and the red subpixels are driven alternately through the source line S1, and the blue subpixels and the red subpixels are driven alternately through the source line S2. If the white color is shown, every column of subpixels (Col1-Col4) need to receive the normal high voltage corresponding to the maximum gray level data; hence, no overdrive is required. If a pure color such as red color is shown, the columns Col1 and Col4 of subpixels need to receive the normal high voltage corresponding to the maximum gray level data while the columns Col2 and Col3 of subpixels need to receive the normal low voltage corresponding to the minimum gray level data. In this case, the insufficient charging problem may appear in these subpixels and the corresponding source lines S1 and S2.

In the conventional overdrive method performed in the gray level domain, the maximum voltage that can be used to drive the source lines is equal to the normal high voltage (e.g., 5V), and thus the red subpixels cannot achieve their target voltages with the driving voltages. In comparison, in the overdrive method performed in the gamma voltage domain as proposed by the present invention, the maximum voltage that can be used to drive the source lines may equal 5.5V, which exceeds the normal high voltage required to be received by the red subpixels. Therefore, the source driver may output an overdrive voltage higher than the normal high voltage, allowing the red subpixels to reach their target voltages. As a result, the overdrive method of the present invention may achieve better image quality in the dual gate panel by improving the color saturation, especially for display of pure color(s).

Please note that the present invention aims at providing an overdrive method in the gamma voltage domain based on the voltage values of the source line, where an overdrive voltage higher than the normal high voltage may be provided. Those skilled in the art may make modifications and alternations accordingly. For example, the values of the gray level codes, the gamma codes, the gamma voltages and the overdrive voltages are merely served as examples for illustrating the present embodiments. It is possible to use other voltage values and/or data codes according to system requirements. For example, the maximum overdrive voltage may be configured to be 5.3V, 5.5V, 6V or any other possible value. In the above embodiment, the overdrive method is applied to the dual gate structure, but should not be limited thereto. In addition to the abovementioned situation of pure color display, the overdrive method is applicable to any image or color where there is a voltage difference between two consecutive subpixel data to be transmitted to the same source line. Further, as for the above embodiments where the overdrive scheme is performed, the buffer may be a line buffer for storing a previous line data. In another embodiment, the overdrive scheme may refer to any previous subpixel data transmitted on the same source line. For example, a larger buffer circuit such as a frame buffer may be applied as the buffer 126 shown in FIG. 1, and more rows of subpixel data on the same source line are considered for obtaining the overdrive voltage.

Figure 6:
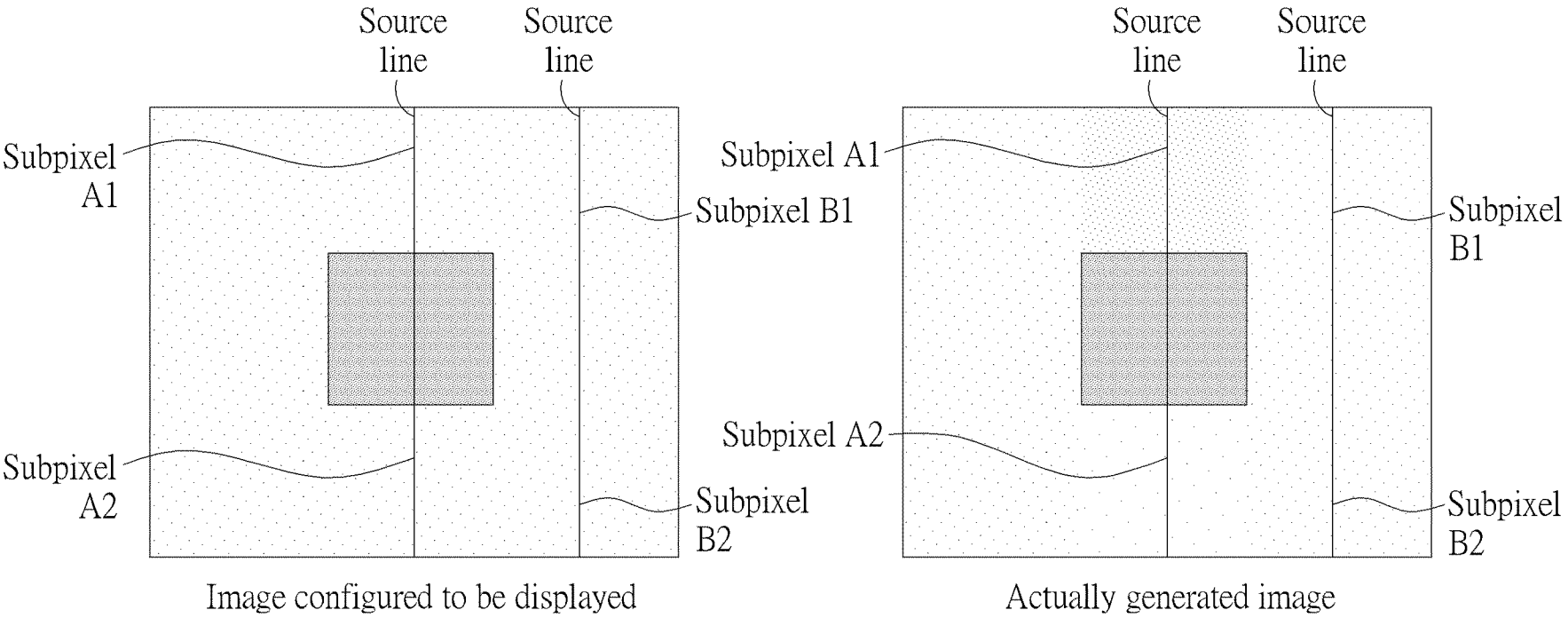
FIG. 6 is a schematic diagram of an image displayed in an image frame.

In an embodiment, the source line is driven with an overdrive voltage for a specific subpixel according to comparison of a gamma voltage for the specific subpixel with the summation of a plurality of previous voltages transmitted through the same source line. Note that the voltage of the specific subpixel connected to the source line may be influenced by previous voltages on the same source line, and these previous voltages may be of the current image frame or a previous image frame. Therefore, all of these previous voltages may be considered in order to generate a precise overdrive voltage. For example, as shown in FIG. 6, a gray image with a black rectangle is configured to be displayed in an image frame. However, in an actually generated image without the overdrive method considering previous voltages, the brightness of subpixels A1 and A2 may be influenced by the black rectangle and thus the subpixels A1 and A2 may show a wrong image, while the subpixels B1 and B2 are correct. Therefore, the overdrive operation for the subpixels A1 and A2 may be performed in consideration of the black rectangle, in order to obtain the precise brightness and correct image.

As mentioned above, the buffer 126 may be implemented as a frame buffer. In addition, the overdrive unit 122 is able to combine the previous voltages on the same source line. For example, a summation circuit or summation unit (not illustrated) may be included for combining the previous voltages. In an exemplary embodiment, the overdrive voltage for a specific subpixel may be determined based on the summation of the voltages of subpixels upper than the specific subpixel in the same image frame and the voltages of subpixels lower than the specific subpixel in the previous image frame. The summation result may be compared with the present voltage required to be received by the specific subpixel, so as to determine the overdrive voltage.

Figure 7:
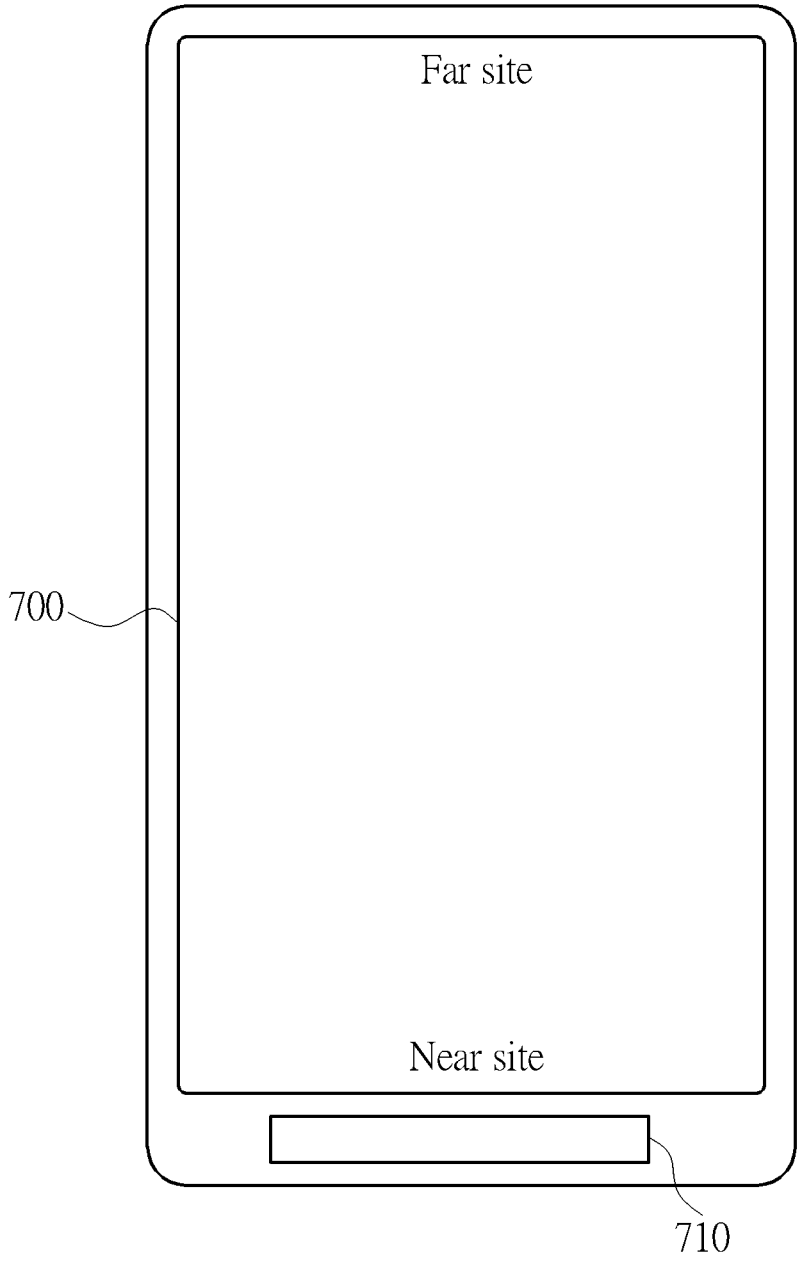
FIG. 7 is a schematic diagram of a common mobile phone with a display panel.
Figure 8:
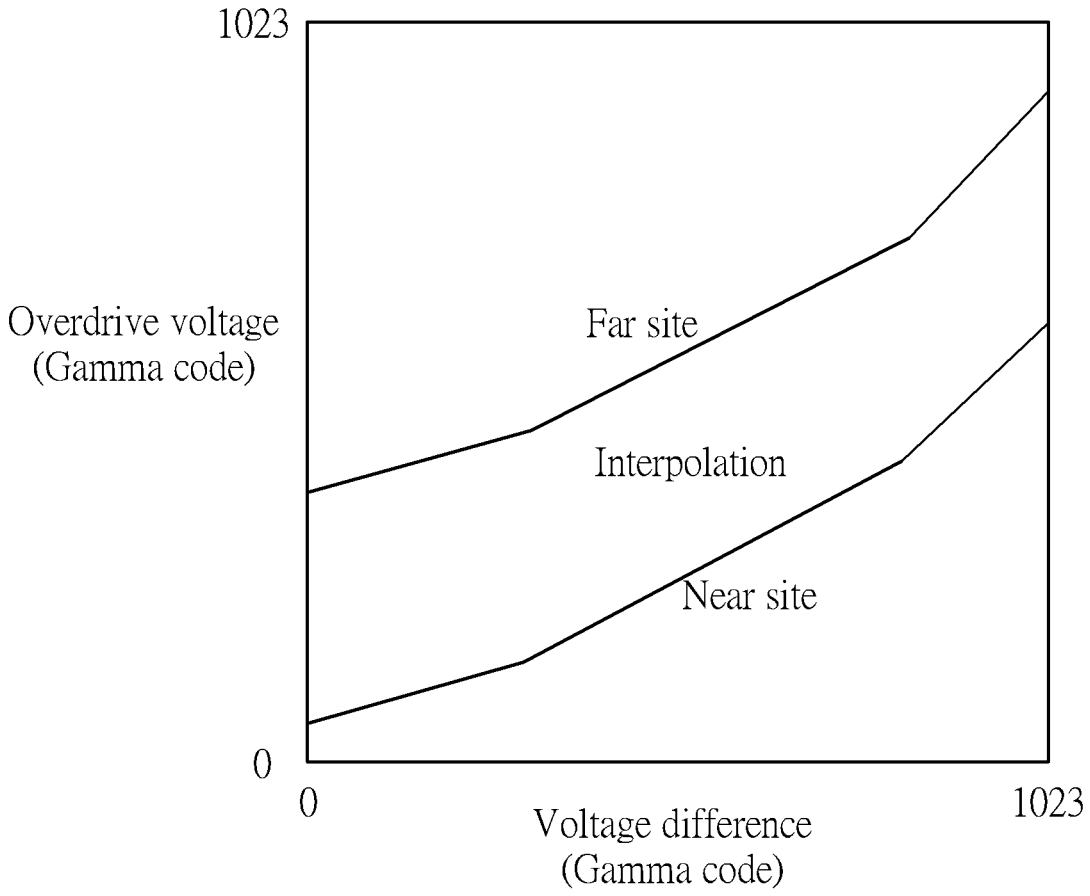
FIG. 8 illustrates an exemplary overdrive compensation scheme based on the distance of the subpixels.

In an embodiment, the overdrive operation may be performed based on the distance between the subpixel and the source driver outputting voltages to the subpixel. Please refer to FIG. 7, which is a schematic diagram of a common mobile phone with a display panel 700. The display panel 700 is controlled by a driver circuit 710 disposed at the bottom of the mobile phone, where the driver circuit 710 may include a timing controller, a gamma voltage generator and a source driver as the structure shown in FIG. 1. As mentioned above, the insufficient charging problem is generated due to the RC loading on the panel. The source driver may drive every subpixel in the display panel 700, and different subpixels in different places may face different levels of RC loading. In general, the subpixels in the far site (i.e., near the top of the mobile phone) may be confronted with larger RC loading since the distances between these subpixels and the source driver are further, and the subpixels in the near site (i.e., near the bottom of the mobile phone) may be confronted with smaller RC loading since the distances between these subpixels and the source driver are nearer. Therefore, different overdriving levels may be applied to those subpixels in different sites. FIG. 8 illustrates an exemplary overdrive compensation scheme based on the distance of the subpixels. As shown in FIG. 8, with identical voltage difference on the source line, the subpixels in the far site have higher overdrive voltages compared to those in the near site. The overdrive voltages for the subpixels between the far site and near site may be determined in an interpolation manner.

Please note that different display panels may have different RC loading. For example, a panel with higher resolution and larger size may have larger RC loading, and therefore be configured to receive higher overdrive voltages for identical voltage difference on the source line.

Figure 9:
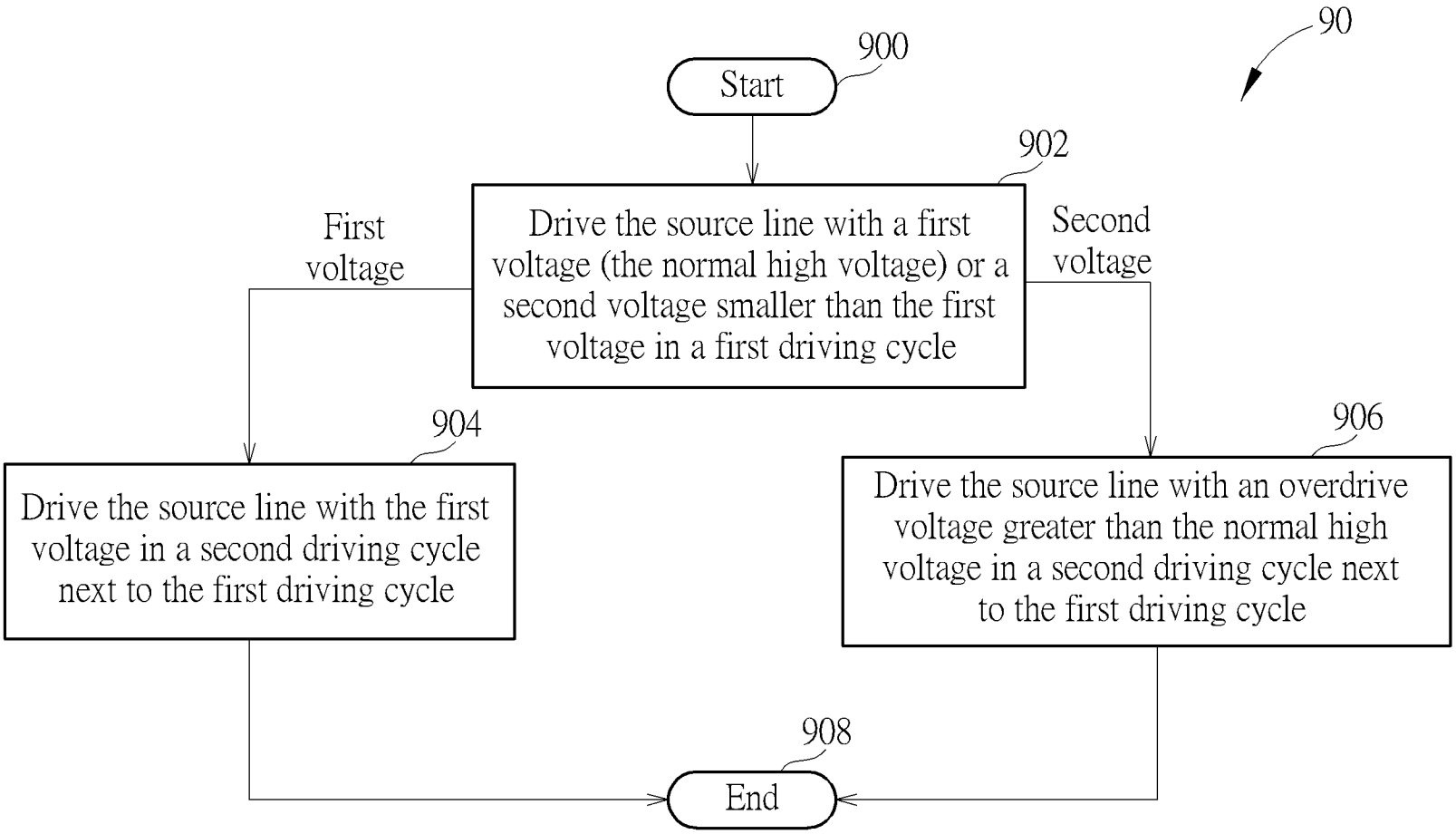
FIG. 9 is a schematic diagram of a overdrive process according to an embodiment of the present invention.

The abovementioned overdrive method may be summarized into an overdrive process 90, as shown in FIG. 9. The overdrive process 90, which may be implemented in a display system such as the display system 10 shown in FIG. 1 for driving a source line of the display panel 108, includes the following steps:

Step 900: Start.

Step 902: Drive the source line with a first voltage (the normal high voltage) or a second voltage smaller than the first voltage in a first driving cycle. If the source line is driven with the first voltage, go to Step 904; and if the source line is driven with the second voltage, go to Step 906.

Step 904: Drive the source line with the first voltage in a second driving cycle next to the first driving cycle.

Step 906: Drive the source line with an overdrive voltage greater than the normal high voltage in a second driving cycle next to the first driving cycle.

Step 908: End

The detailed operations and alternations of the overdrive process 90 are illustrated in the above paragraphs, and will not be narrated herein.

To sum up, the present invention provides an overdrive method performed in the gamma voltage domain, where the overdrive operation is determined based on the voltage difference on the source line. Headroom is included in the gamma voltage domain, allowing the source line to be driven by an overdrive voltage higher than the normal high voltage; hence, the overdrive may be effective for high gray level data. In an embodiment, the overdrive unit may generate the overdrive gamma code by referring to a line buffer containing information of the gamma voltage transmitted to the source line in the previous driving cycle. In another embodiment, the overdrive unit may generate the overdrive gamma code by referring to a frame buffer containing information of the gamma voltages transmitted to the source line in the present frame and previous frame. The distance between the target subpixel and the source driver may also be considered, where the overdrive degree is predicted based on the RC loading of the panel, so as to obtain a precise overdrive voltage. As a result, the overdrive method of the present invention is able to provide satisfactory performance on overdrive compensation for high gray level data.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driving method for a source driver, for driving a source line of a display panel, the driving method comprising:

driving the source line with a first voltage or a second voltage smaller than the first voltage in a first driving cycle;

driving the source line with the first voltage in a second driving cycle next to the first driving cycle when the source line is driven with the first voltage in the first driving cycle; and driving the source line with an overdrive voltage in the second driving cycle when the source line is driven with the second voltage in the first driving cycle;

wherein the first voltage is a normal high voltage of the display panel, and the overdrive voltage is greater than the normal high voltage;

wherein the first voltage is converted from a first gamma code, and the overdrive voltage is converted from an overdrive gamma code greater than the first gamma code.

2. The driving method of claim 1, wherein the normal high voltage corresponds to a maximum brightness of a color shown on the display panel.

3. The driving method of claim 1, wherein the normal high voltage is converted from a maximum gray level of a color.

4. The driving method of claim 1, further comprising:

driving the source line with a third voltage for a subpixel of the display panel according to a distance between the subpixel and a source driver outputting the third voltage.

5. The driving method of claim 1, further comprising:

driving the source line with the overdrive voltage for a subpixel of the display panel according to comparison of a gamma voltage for the subpixel with a summation of a plurality of previous voltages transmitted through the source line.

6. A display system, comprising:

a display panel, comprising a plurality of source lines;

a timing controller, configured to output a first gamma data, a second gamma data and an overdrive gamma data according to a first gray level data and a second gray level data;

a gamma voltage generator, coupled to the timing controller, configured to output a first voltage corresponding to the first gamma data, a second voltage corresponding to the second gamma data, and an overdrive voltage corresponding to the overdrive gamma data; and a source driver, coupled to the display panel and the gamma voltage generator, configured to perform the following steps:

driving a source line among the plurality of source lines with the first voltage or the second voltage smaller than the first voltage in a first driving cycle;

driving the source line with the first voltage in a second driving cycle next to the first driving cycle when the source line is driven with the first voltage in the first driving cycle; and driving the source line with the overdrive voltage in the second driving cycle when the source line is driven with the second voltage in the first driving cycle;

wherein the first voltage is a normal high voltage of the display panel, and the overdrive voltage is greater than the normal high voltage.

7. The display system of claim 6, wherein the normal high voltage corresponds to a maximum brightness of a color shown on the display panel.

8. The display system of claim 6, wherein the normal high voltage is converted from a maximum gray level of a color.

9. The display system of claim 6, wherein the source driver is further configured to perform the following step:

driving the source line with a third voltage for a subpixel of the display panel according to a distance between the subpixel and the source driver.

10. The display system of claim 6, wherein the source driver is further configured to perform the following step:

driving the source line with the overdrive voltage for a subpixel of the display panel according to comparison of a gamma voltage for the subpixel with a summation of a plurality of previous voltages transmitted through the source line.

* * * * *